United States Patent [19]

Linnér

[11] 4,092,906

[45] June 6, 1978

[54] CARTON FLAP FOLDING MECHANISM

[75] Inventor: Hans Rolf Ingemar Linnér, Helsingborg, Sweden

[73] Assignee: AB Akerlund & Rausing, Lund, Sweden

[21] Appl. No.: 777,721

[22] Filed: Mar. 15, 1977

[30] Foreign Application Priority Data

Nov. 12, 1976 Sweden ..... 7612634

[51] Int. Cl.[2] ..... B31B 1/52

[52] U.S. Cl. ..... 93/49 R

[58] Field of Search ..... 53/374, 375; 93/49 R, 93/49 M, 53 R, 36.8

[56] References Cited

U.S. PATENT DOCUMENTS

| | | | |
|---|---|---|---|
| 868,292 | 10/1907 | Redd | 53/374 |
| 2,625,778 | 1/1953 | Wood | 53/374 X |
| 2,651,153 | 9/1953 | Burnett | 53/374 X |
| 3,068,761 | 12/1962 | Engleson et al. | 93/49 R |
| 3,602,107 | 8/1971 | Zimmer et al. | 93/49 R |
| 3,618,480 | 11/1971 | Theys et al. | 93/49 R |

*Primary Examiner*—James F. Coan

*Attorney, Agent, or Firm*—Lerner, David, Littenberg & Samuel

[57] ABSTRACT

A packaging machine is disclosed in which leading and trailing carton flaps are folded by means of a pair of folding pins positioned intermediate adjacent cartons in a series of cartons. The folding pins are movable along substantially circular paths to fold the flaps inwards over the ends of the cartons positioned adjacent to each other.

7 Claims, 4 Drawing Figures

CARTON FLAP FOLDING MECHANISM

BACKGROUND OF THE INVENTION

The present invention relates to packaging machines in which a series of folding boxes fed one after another in a predetermined direction with a substantially constant center to center distance are processed in various stations and, more particularly, to a box flap folding station for such a machine which is adjustable for processing different size boxes.

Principally, such a machine comprises an endless conveyor, such as a chain or a band running in the horizontal plane and provided with equally spaced carriers for folding boxes of cardboard or similar material. From a plane condition in a storage area the folding boxes are fed to the conveyor and simultaneously erected into a substantially case-shaped configuration with top and bottom endwall flaps extending from the body portion of the folding box. In a conventional machine of this type the erected folding boxes are conveyed to the following stations: a transverse-wall and longwall flap unfolding station, a sealing strip application and sealing station, a sealing strip cross-cutting station and a flap folding and sealing station. These stations are located along a rectilinearly extending portion of the conveyor and operate upon the bottom ends of the folding boxes. After the bottom sealing has been accomplished, at the end of the rectilinear portion the folding boxes are filled in a filling station, preferably situated along a curved portion of the conveyor after which the folding boxes are conveyed along a second rectilinear portion in a direction opposite to that of the first rectilinear portion. With the exception of the transverse-wall and longwall flap unfolding station, the second rectilinear portion is provided with stations identical with those of said first portion, however with the difference that the latter operate upon the top ends of the folding boxes. At the end of the second rectilinear portion there is a discharge station for the filled and sealed folding boxes.

Basically, this machine is reliable and practical. However, it would be desirable to provide a flap folding station which is operable within a maximally large size range. With the known machine in such a case unfavorable stresses in the flaps are obtained at certain sizes and difficulties arise when the distance is small between adjacent flaps of successive folding boxes.

It is therefore an object of this invention to provide flap folders having optimal paths of travel with respect to stress loading of the flaps.

It is a further object of this invention to simply adjust the paths of travel and to simultaneously ensure that the paths will be optimal as regards to the intended inwards folding of the flaps for various folding box sizes.

SUMMARY OF THE INVENTION

This invention accordingly provides an arrangement for use in a size-adjustable packaging machine in which a sealing strip is sealed to at least one open end of each folding box of a series of folding boxes fed one after another in a predetermined direction with a substantially constant center to center distance, and in which at least one pair of oppositely positioned sidewall flaps at said end of the folding box is folded inwards over the sealing strip, the arrangement being characterized by a pair of folding pins movable to be pressed against adjacent sidewall flaps in the series of folding boxes, each of said folding pins moving along a substantially partly circular path of travel with the center of the circular path of travel spaced from the plane of said open end in direction towards the opposite end of the box, and which in a first phase of movement fold said flaps inwards over the ends of the folding boxes positioned adjacent to each other.

In a preferred embodiment the paths of travel further are such that they intersect each other in the space between adjacent folding boxes.

DESCRIPTION OF THE DRAWING

In order to clearly explain the inventive concept a preferred embodiment thereof now will be described with reference to the drawings in which.

DESCRIPTION OF THE PREFERRED EMBODIMENT

Figure 1:
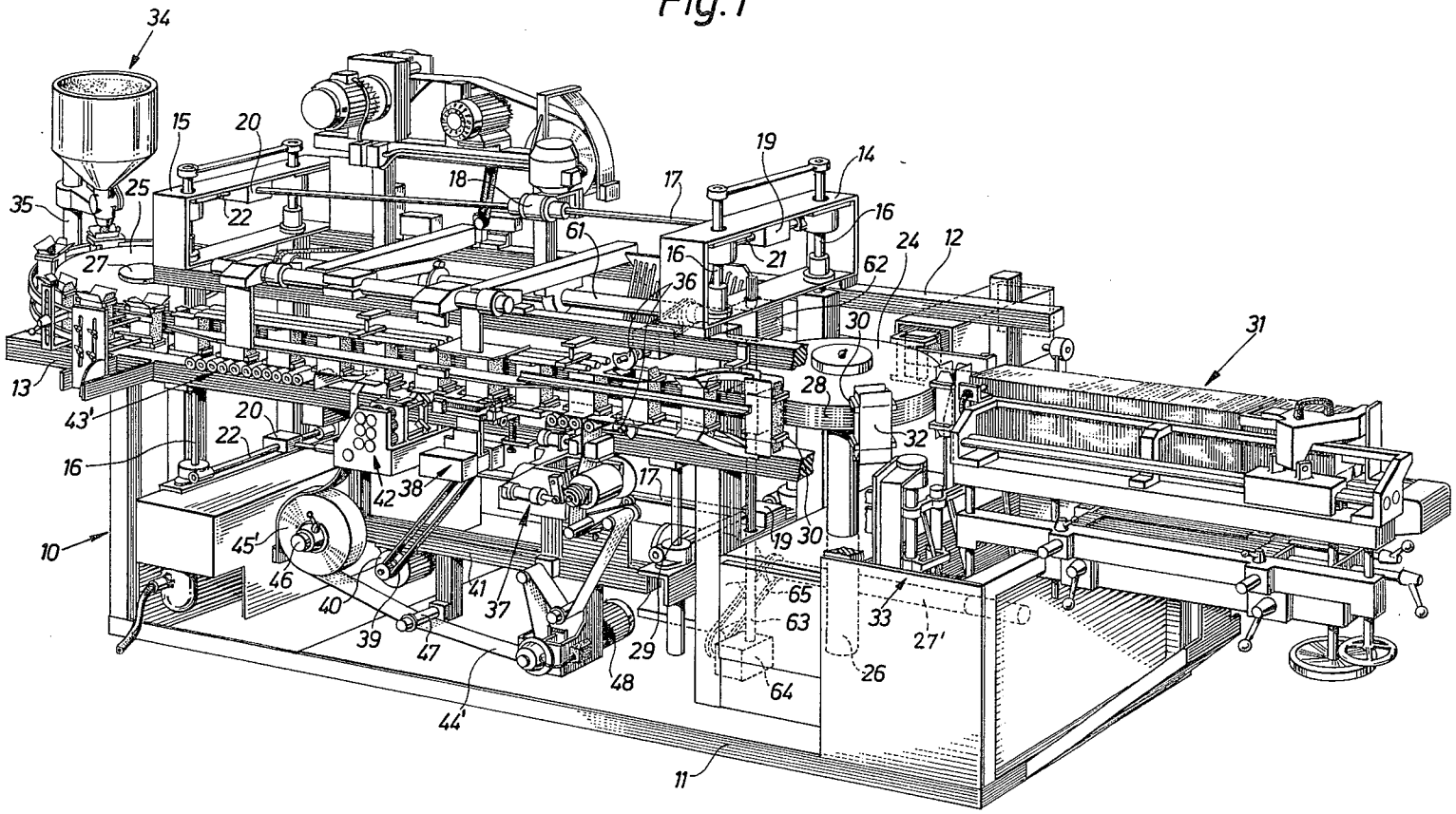
FIG. 1 is a perspective view of a packaging machine including the arrangement according to this invention.

The packaging machine shown in FIG. 1 is provided with a main stand 10 which by means of a bottom frame 11 rests upon a substantially horizontal floor. The main stand 10 carries an upper deck 12 and a lower deck 13, respectively, which are simultaneously vertically displaceable in opposite directions. Each of said decks consists of a frame structure. In the area of the transverse ends the upper deck 12 is provided with box-like housings 14 and 15. Each of the housings serves as a guide means for the top ends of a pair of jack screws 16. The housings 14 and 15 are interconnected by means of a shaft 17, which is driven by a worm gear motor 18, and by means of worm gears 19, 20 in the two housings 14, 15 transverse shafts 21, 22 are driven which in turn rotate the screws 16 when the motor 18 is running. The lower deck 13 is provided with a corresponding set of shafts and worm gears and a worm gear motor. Owing to the fact that the screws 16 have oppositely threaded portions in the areas of the deck 12 and the deck 13, respectively, the deck 12 and the deck 13 will be moved vertically in opposite directions responsive to the rotation of the screws 16. If the threads of screws 16 have the same pitch, the movement in opposite directions of course will have equal displacements.

The stand 10 by means of shafts 26, 27 carries a pair of wheels 24, 25 about which an endless steel band 28 is running and extends in the horizontal plane. The shaft 26 by means of a drive shaft 27' is driven from a main motor 29. The wheel 24 therefore is the driving wheel of the two wheels 24, 25, and by controlling the motor 29, such as by frequency control, the wheel 24 and accordingly the band 28 may be given a desired driving speed, at which the movement in the shown embodiment will be an intermittent movement with a variable speed. On the band 28 are mounted equidistant carriers 30. In the shown embodiment carriers for folding boxes of moderate size are shown, but these carriers may be replaced by carriers of a smaller or larger size, and thus the distance between the carriers, as measured between adjacent carrier arms, will vary dependent upon the selected folding box size. It is for instance possible to use folding boxes having a length in the conveying direction as small as 65 mm and as large as 142 mm. The carriers 30 are tightened on the band 28 and are easily replaceable.

At the right end of the machine shown in FIG. 1 the stand 10 carriers a storage area 31 for folding boxes in plane condition. The storage area 31 is provided with a gripper means 33 which removes individual plane folding boxes from the storage area and inserts them one by one into the carriers 30 while the folding boxes simultaneously are erected as shown in FIG. 1. The storage area and the gripper means are of the type described in copending U.S. patent application Ser. No. 777,720, filed concurrently herewith on Mar. 15, 1977. At the curved left end of the conveyor in FIG. 1 is mounted a filling means 34 which may be carried either directly by the stand 10 or, as indicated, by a separate stand 35.

Apart from a pair of endflap unfolders 36, along the two straight conveyor portions identical processing stations are provided for the bottom ends and top ends of the folding boxes, and in this connection therefore merely the processing stations for the bottom ends will be described, i.e. the stations and means carried by the lower deck 13.

With reference to the endflap unfolders 36 these are of known construction, such as of the type described in Swedish Pat. Nos. 342,180; 342,181 or 343,519. The purpose of the flap unfolders is to unfold the upper and lower transverse flaps into a horizontal position, in order to make it possible to apply a sealing strip against the bottom end and the top end, respectively, of the folding box. The longwall flaps are also unfolded into horizontal position, by longwall flap guide means preceding the unfolders 36.

As seen in the conveying direction, after the flap unfolders 36 follows the sealing strip application station 37 according to copending U.S. patent application Ser. No. 777,722, filed concurrently herewith on Mar. 15, 1977.

After the sealing strip application station, still as seen in the conveying direction of the folded boxes, follows a sealing strip sealing station 38 which in the shown embodiment is provided with a vibration heating jaw, such as of the type described in U.S. Pat. No. 3,787,257. The vibration heating jaw in the sealing station 38, by means of a chain 39, is driven from a drive motor 40 controlled in response to the speed of the main motor 29. This means that the vibration frequency of the heating jaw will be directly dependent on the speed of the motor 29 and consequently also on that of the conveyor band 28. Like the various units in the sealing strip application station 37, this motor 40 is carried by a subframe 41 secured to the lower deck 13.

After the sealing label sealing station 38 follows a transverse-flap folding station 42 according to this invention. Then follows a known longwall flap folder in the shape of lengthened rails (not shown) serving as guide means for said flaps and folding them inwards over the transverse flaps previously folded inwards in the station 42. Said longwall flap folder alternatively may be of a type similar to the transverse flap folder.

At the end of the straight portion of the conveyor is situated a flap sealing station 43' which consists of a number of conventional heating elements.

After the individual folding boxes have been conveyed along the straight portion of the conveyor just described, they are ready to be filled from their top in the filling station 34.

In accordance with the principles of this invention, the flap folding mechanism indicated generally by reference numeral 42 in FIg. 1 is provided. Since the flap folder 42 is coordinated with the bottom ends of the folding boxes 32, it is supported on the lower deck 13 by carrier means 43 (FIG. 2) fixedly mounted thereon.

The folding pins 44, 45 included in the flap folding station 42 are driven from the main motor 29 of the machine. Each of the decks 12 and 13, respectively, has longitudinal cam shafts 61 and 61', respectively, (FIGS. 1 and 3) which are driven from the main motor 29 by means of the shaft 27' of the motor, a chain 65, a worm gear 64, a vertical shaft 63, and worm gears coordinated with the upper and lower deck, respectively. Since the main motor 29 also drives the conveyor band 28, the rotation speed of the cam shafts 61, 61' will be directly dependent on the feeding speed of the folding box.

Figure 3:
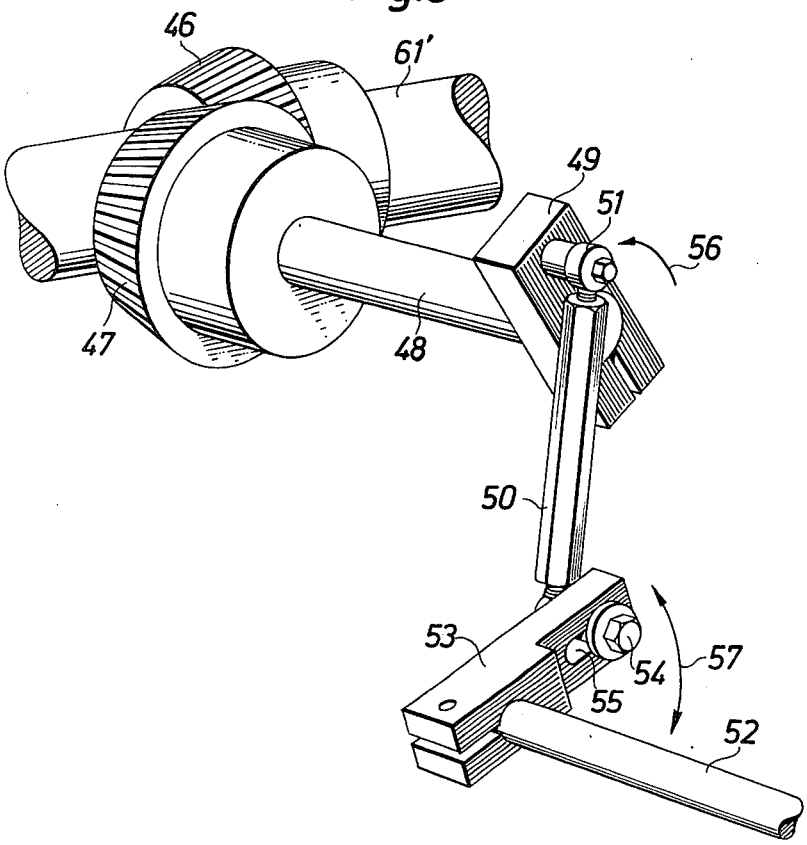
FIG. 3 is a perspective view of the drive of the flap folder.

FIG. 3 shows how the lower cam shaft 61' by means of a pair of worm gears 46, 47 drives a crankshaft 48 having a crankweb 49 fixedly mounted thereon. On the crankweb 49 a pin 50 is journalled at 51.

Vertically spaced from the shaft 48, which is journalled in the carrier 43, is a second shaft 52 also journalled in the carrier 43. On the shaft 52 a second crankweb 53 is fixedly mounted. At its free end the crankweb 53 is rotatably mounted about a bolt 54 which is journalled in the bottom end of the pin 50. The bolt 54 is adjustable in a groove 55 in the crankweb 53. By this means the rotary motion of the shaft 52 may be adjusted as desired.

The crankweb 49 rotates in the direction indicated by the arrow 56. However, due to the crankweb mechanism described above, the crankweb 53 and accordingly the shaft 52 will perform a reciprocal movement as indicated by the doubleheaded arrow 57.

Figure 2:
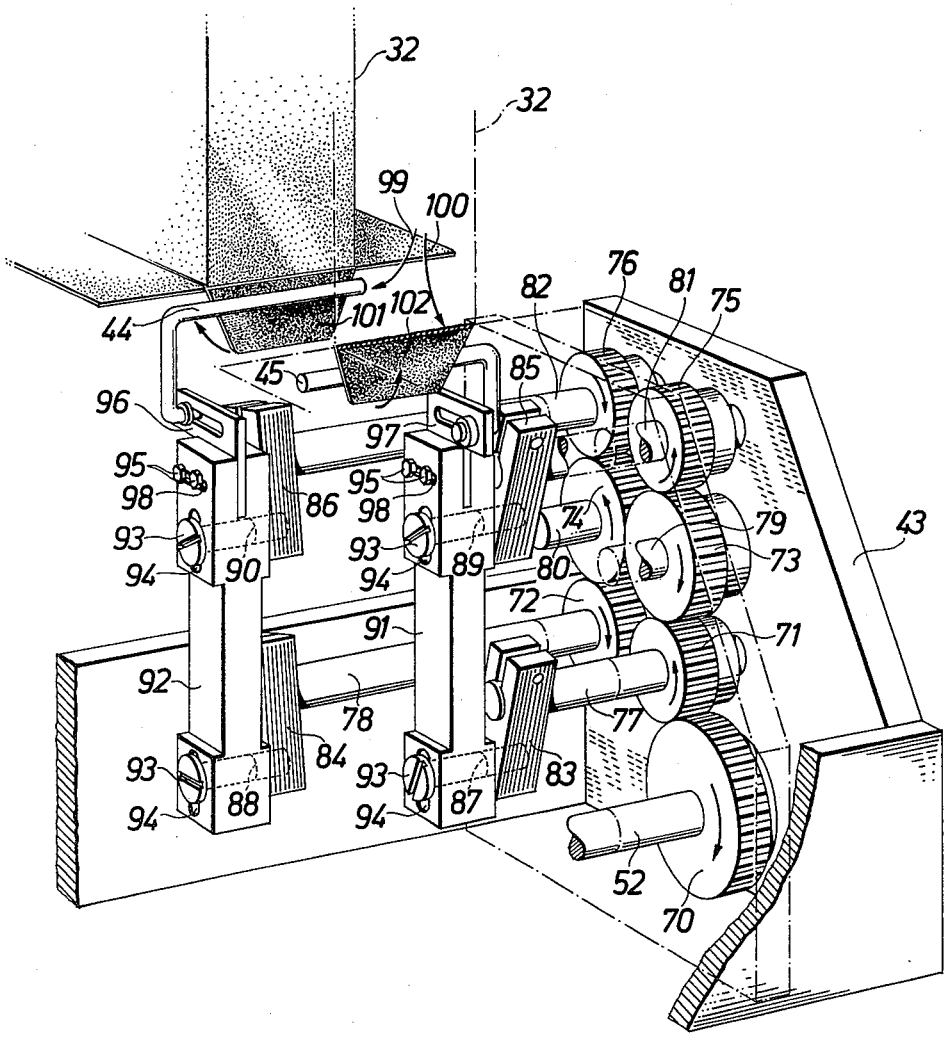
FIG. 2 is a schematic perspective view of an embodiment of the flap folder.

As appears from FIG. 2, a driving gear wheel 70 is fixedly mounted on the shaft 52. The gear wheel 70 drives a gear mechanism consisting of six meshing gear wheels 71–76. Each of these gear wheels is secured to respective shafts 77–82, each of which at one end of its end is journalled in the carrier 43. At the opposite ends, the shafts 77, 78 and 81, 82 are each secured to crank arms 83, 84 and 85, 86, respectively. the crank arms 83–86 at their outer ends are pivotally journalled at 87–90 in vertical arms 91, 92. By means of bolts 93 the arms 91, 92 are adjustable in vertical direction in relation to the crank arms 83–86, in that the arms after easing off of the bolts may be displaced in grooves 94.

At the top ends of the arms 91, 92 are mounted horizontal arms 96, 97 carried by bolts 95. The bolts 95 are displaceable in grooves 98 by means of which the arms 96, 97 are horizontally adjustable.

The arms 96, 97 carry the folding pins 44, 45.

It appears from FIG. 2 that the crank arms 83, 85 and 84, 86 respectively, are mutually parallel. The arrows 99, 100 in FIG. 2 indicate that the folding pin 44 with the given direction of rotation of gear wheel 70 will move along a path of travel in the direction of the arrow 99, and that the folding pin 45 will move along a path of travel in the direction of the arrow 100. Said paths of travel are parts of the periphery of circles. It further appears from FIGS. 2 and 3 and the above description that the movement of the folding pins 44, 45 along said periphery-parts may be performed in mutually opposite directions since the crankweb mechanism shown in FIG. 3 principally is an eccentric mechanism having two dead centers in which the direction of movement of the shaft 52 is reversed at each passage therethrough.

Figure 4:
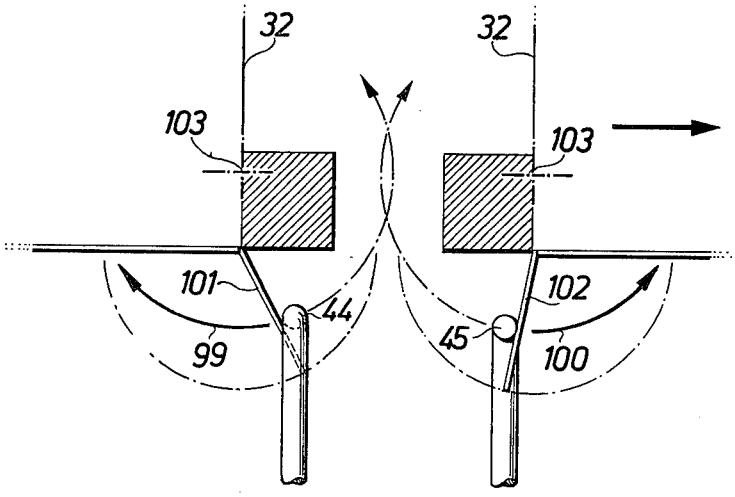
FIG. 4 schematically shows the paths of travel of the folding pins.

From FIG. 2 it also appears that the folding pin 44 is mounted at a higher level in the vertical direction than the folding pin 45. Such a vertical adjustment is easily effected by means of the illustrated arm mechanism. It also appears from FIG. 2 and FIG. 4 that the paths of travel of the folding pins intersect each other in the area between folding boxes 32 positioned adjacent each other. This adjustment in the horizontal direction also is facilitated by the described arrangement.

As has been mentioned, it is important that the flap folders allow a maximum use of the avabilable space between flaps 101, 102 positioned close by each other of two adjacent folding boxes in the series fed by the conveyor. As will appear from the following description of the function, this has been made possible in that the folding pins 44, 45 have received expedient paths of travel while maintaining optimal flap folding properties.

The shown flap folding mechanism particularly is intended for an intermittently operating machine, i.e. the machine shown in FIG. 1. As mentioned, the eccentric mechanism shown in FIG. 3 has a first and a second dead center. The first dead center corresponds to the uppermost position of the flap folders 44, 45. The folding box conveyor 28 in this case is stationary. In this position the flap folders 44, 45 start their circular movement downwards and towards the transverse flaps 101, 102 previously unfolded into the horizontal plane of the open end of the folding boxes. As appears from FIGS. 2 and 4 the folding pin 44 first will be moved to contact the end flap 101, after which the folding pin 45 with a predetermined adjustable delay will be moved into contact with the flap 102.

The center of movement 103 of each of the folding pins 44, 45 is situated approximately 15 mm above the bottom end of the respective folding box. This means that during the inwards folding phase the distance between the contact line of the respective pin and the bending line of the flap at the wall of the folding box shell with successively be decreased. In this way a gradually decreasing torque is applied to the flap about the bending line, which will prevent undue stresses being applied to the flap.

When the eccentric mechanism shown in FIG. 3 has assumed its second dead center, the flaps 101, 102 have been folded inwards against the respective folding box end, and simultaneously a new feeding of folding boxes is started in that the conveyor 28 is started. During this phase of movement the flaps 101, 102 are introduced under mechanical guide means (not shown), which retain the flaps in their folded position until the longwall flaps have been folded inwards.

While the conveyor is moved to the next stop position the folding pins 44, 45 return to their uppermost position. Since the center of movement of the folding pins 44, 45 is situated well above the bottom ends of the folding boxes, the folding pins will easily snap over the following flaps 101, 102 of the pair of folding boxes intended to be folded inwards in the next stop position. In order to insure that the folding pins 44, 45 at the following downwards movement are moved into contact with the top sides of the flaps, the distance between the respective pin in its uppermost position and the folding box corner belonging thereto is larger than the flap length.

When the folding pins have returned to their uppermost positions and the conveyor again is stationary, the described movement cycle is started again.

Accordingly, there has been described an improved carton flap folding mechanism. It is understood that the above described embodiment is merely illustrative of the application of the principles of this invention. Numerous other arrangements may be devised by those skilled in the art without departing from the spirit and scope of this invention, as defined by the appended claims.

What is claimed is:

1. A carton flap folding mechanism for use in a packaging machine in which a series of folding boxes having at least one open end, and at least one pair of sidewall flaps oppositely positioned at said open end of the folding box is folded inwards over the open end, said folding mechanism comprising:

a pair of folding pin members each adapted to be movable against a respective sidewall flap of adjacent boxes in the series of folding boxes, the path of movement of each of said pin members being a segment of a substantially circular path of travel, the center of said circular path of travel being between the plane of said open end and the opposite end of the folding box, and wherein during a first phase of movement said folding pin members fold said respective flaps inwards over the open ends of respective folding boxes positioned adjacent each other; and means for moving said folding pin members.

2. The folding mechanism according to claim 1 wherein the paths of movement of the folding pin members are each segments of circles which intersect each other, and further wherein said folding pin members contact the plane of said open ends of the folding boxes positioned adjacent to each other at different times.

3. The folding mechanism according to claim 2 wherein said moving means for each of said folding pin members includes a respective eccentric mechanism, each said respective eccentric mechanism having a first and a second dead center, each said folding pin member at its first dead center being at a first point to initiate its first phase of movement to fold the respective flap inward and at its second dead center being at a second point to initiate a second phase of movement to return to its first dead center simultaneously with the feeding of folding boxes.

4. The folding mechanism according to claim 3 wherein when each of said folding pin members is in its respective first dead center, the distance between said each folding pin member and a respective corner of the folding box is greater than the flap length.

5. The folding mechanism according to claim 4 wherein, during the first phase of movement of each of said folding pin members from its first to its second dead center, each of said pin members is moved into contact with its respective flap to thereby fold it inward over the sealing label applied to said open end and during the second phase of movement of each of said folding pin members from its second to its first dead center, the inwardly folded flaps are held by mechanical guide means and simultaneously the folding pin members snap over the following pair of flaps and return to their respective first dead centers.

6. The folding mechanism according to claim 5 wherein each of said moving means for each of said folding pin members includes a carrying element holding a respective folding pin member, said carrying element being adjustable vertically and horizontally to accommodate different size boxes, said carrying element being mounted on a pair of crank arms rigidly connected to respective shafts, each of said shafts being reversibly driven by a gear wheel mechanism connected to said eccentric mechanism.

7. The folding mechanism according to claim 6 wherein said eccentric mechanism is driven in sychronism with the feeding of the folding boxes.

* * * * *